US005480275A

United States Patent [19]

Talbert et al.

[11] Patent Number: 5,480,275

[45] Date of Patent: Jan. 2, 1996

[54] FORK LIFT TRUCK

[75] Inventors: Donald Talbert, Colorado Springs, Colo.; Robert Patterson, Bastrop; Arnold C. Cuba, Jr., Taylor, both of Tex.

[73] Assignee: Taylor Iron-Machine Works, Inc., Taylor, Tex.

[21] Appl. No.: 137,345

[22] Filed: Oct. 18, 1993

[51] Int. Cl.[6] ..... B66F 9/10

[52] U.S. Cl. ..... 414/635; 187/226; 414/544; 414/664

[58] Field of Search ..... 414/467, 544, 414/628–638, 662–664, 668; 187/9 E, 226

[56] References Cited

U.S. PATENT DOCUMENTS

| | | | |
|---|---|---|---|
| 2,621,812 | 12/1952 | Lull | 414/544 |
| 2,752,058 | 6/1956 | Gibson | 414/664 X |
| 2,897,985 | 8/1959 | Carlson et al. | 414/544 |
| 2,904,201 | 9/1959 | Rhodes | 414/467 |
| 2,966,275 | 12/1960 | Brookins | 414/462 |
| 2,973,878 | 3/1961 | Gibson | 414/664 |
| 3,162,317 | 12/1964 | Becker | 414/664 |
| 3,174,634 | 3/1965 | Peck | 414/541 |
| 3,235,105 | 2/1966 | Loomis | 414/544 |
| 3,259,257 | 7/1966 | Brown et al. | 414/544 |
| 3,266,599 | 8/1966 | Dearden | 414/635 |
| 3,353,697 | 11/1967 | Martin et al | 414/607 |
| 3,365,214 | 1/1968 | Garnett | 280/763.1 |
| 3,390,797 | 7/1968 | Goodacre et al. | 414/467 |
| 3,407,950 | 10/1968 | Ward et al. | 414/462 |
| 3,481,498 | 12/1969 | Sturtz, Jr. | 414/592 |
| 3,563,341 | 2/1971 | Bultman | 187/232 |
| 3,695,471 | 10/1972 | Rivers, Jr. | 414/498 |
| 3,710,965 | 1/1973 | Joosten | 414/467 |
| 3,754,673 | 8/1973 | Barda et al. | 414/667 |
| 3,788,507 | 1/1974 | Voss | 414/467 X |
| 3,799,379 | 3/1974 | Grether et al. | 414/467 |
| 3,809,250 | 5/1974 | Pilch | 212/261 |
| 3,831,774 | 7/1974 | Moore | 280/765.1 |
| 3,841,503 | 10/1974 | Hollenbach | 414/541 |
| 3,861,535 | 1/1975 | Huxley, III et al. | 414/460 X |
| 3,885,692 | 5/1975 | Anderson, Jr. | 414/607 X |
| 3,930,668 | 1/1976 | Schuermann et al. | 280/763.1 X |
| 3,933,372 | 1/1976 | Herndon | 280/763.1 |
| 3,953,052 | 4/1976 | Palmcrantz | 280/763.1 |

(List continued on next page.)

FOREIGN PATENT DOCUMENTS

| | | | |
|---|---|---|---|
| 1395966 | 3/1965 | France | 414/631 |
| 1009562 | 5/1957 | Germany | 414/631 |
| 1950633 | 4/1971 | Germany | 414/544 |
| 148800 | 5/1992 | Japan | 414/544 |
| 8300147 | 8/1984 | Netherlands | 414/631 |
| 8201363 | 4/1982 | WIPO | 414/631 |

OTHER PUBLICATIONS

"Counterbalanced Forklift Trucks: Workhorse that continues to Deliver the Goods", Materials Handling, Supplement 1988.

Princeton's "Piggyback" Material Handler, Brochure prepared by the Princeton Manufacturing Company.

Schwind, Gene F. "Boom–Type Lift Trucks": Versatility in the Rough.

Schwind, Gene P. "Industrial Truck Report": What's New in Powered Industrial Trucks.

*Primary Examiner*—David A. Bucci

*Attorney, Agent, or Firm*—Penrose Lucas Albright

[57] ABSTRACT

An improved fork lift truck having a scissor-actuated horizontal carriage motion system mounted on a horizontal frame. The carriage motion system providing for selectable positioning in a compact space of a lift assembly between a position forward of and behind the front wheels. The lift assembly provides downward pressure and is vertically moveable from and to a position which is below ground level and a further position above the level of the fork lift truck. The fork lift truck also provides a pair of outriggers which discontinue movement and remain stationary if they contact an obstruction, while the other outriggers continue to extend, the outriggers being moveable both horizontally and vertically relative to the remainder of the lift truck.

15 Claims, 6 Drawing Sheets

U.S. PATENT DOCUMENTS

| | | | |
|---|---|---|---|
| 3,963,129 | 6/1976 | Clayton | 414/563 |
| 4,026,428 | 5/1977 | Schumaker | 414/694 |
| 4,027,801 | 6/1977 | Johnston et al. | 280/763.1 |
| 4,049,083 | 9/1977 | Garvey | 187/232 |
| 4,082,197 | 4/1978 | Stedman | 414/718 X |
| 4,219,298 | 8/1980 | Stragler et al. | 414/544 X |
| 4,236,862 | 12/1980 | McCormick | 414/633 |
| 4,261,438 | 4/1981 | Olson | 187/9 E |
| 4,266,795 | 5/1981 | Walker | 414/467 X |
| 4,276,961 | 7/1981 | Sugiyama | 187/9 E |
| 4,280,592 | 7/1981 | Bartow | 187/9 E |
| 4,312,427 | 1/1982 | Stedman | 187/9 E |
| 4,355,703 | 10/1982 | Bartow | 187/9 E |
| 4,356,891 | 11/1982 | Bartow | 187/9 E |
| 4,356,893 | 11/1982 | Johannson | 187/9 E |
| 4,359,127 | 11/1982 | Arnold | 180/252 |
| 4,365,921 | 12/1982 | Brower et al. | 414/631 X |
| 4,374,550 | 2/1983 | Bartow | 187/9 E |
| 4,396,341 | 8/1983 | Brouwer et al. | 414/467 X |
| 4,413,708 | 11/1983 | Stedman | 414/644 X |
| 4,415,302 | 11/1983 | Brouwer et al. | 414/664 X |
| 4,421,208 | 12/1983 | Robinson, Jr. | 187/9 E |
| 4,467,893 | 8/1984 | Hobson | 414/607 X |
| 4,482,286 | 11/1984 | Farmer et al. | 414/607 |
| 4,505,635 | 3/1985 | Shinoda et al. | 187/9 E X |
| 4,506,764 | 3/1985 | Griesenbrock et al. | 187/9 E |
| 4,515,520 | 5/1985 | Parquet et al. | 280/765.1 X |
| 4,520,903 | 6/1985 | Arnold et al. | 187/222 |
| 4,531,615 | 7/1985 | Wible | 187/9 E |
| 4,614,253 | 9/1986 | Furukawa | 187/9 E |
| 4,826,474 | 5/1989 | Holmes | 414/467 X |
| 4,890,692 | 1/1990 | Oakman | 182/141 |
| 4,921,075 | 5/1990 | Schumacker et al. | 414/663 X |
| 5,082,090 | 1/1992 | Walker | 187/9 E |

FIG. 1b
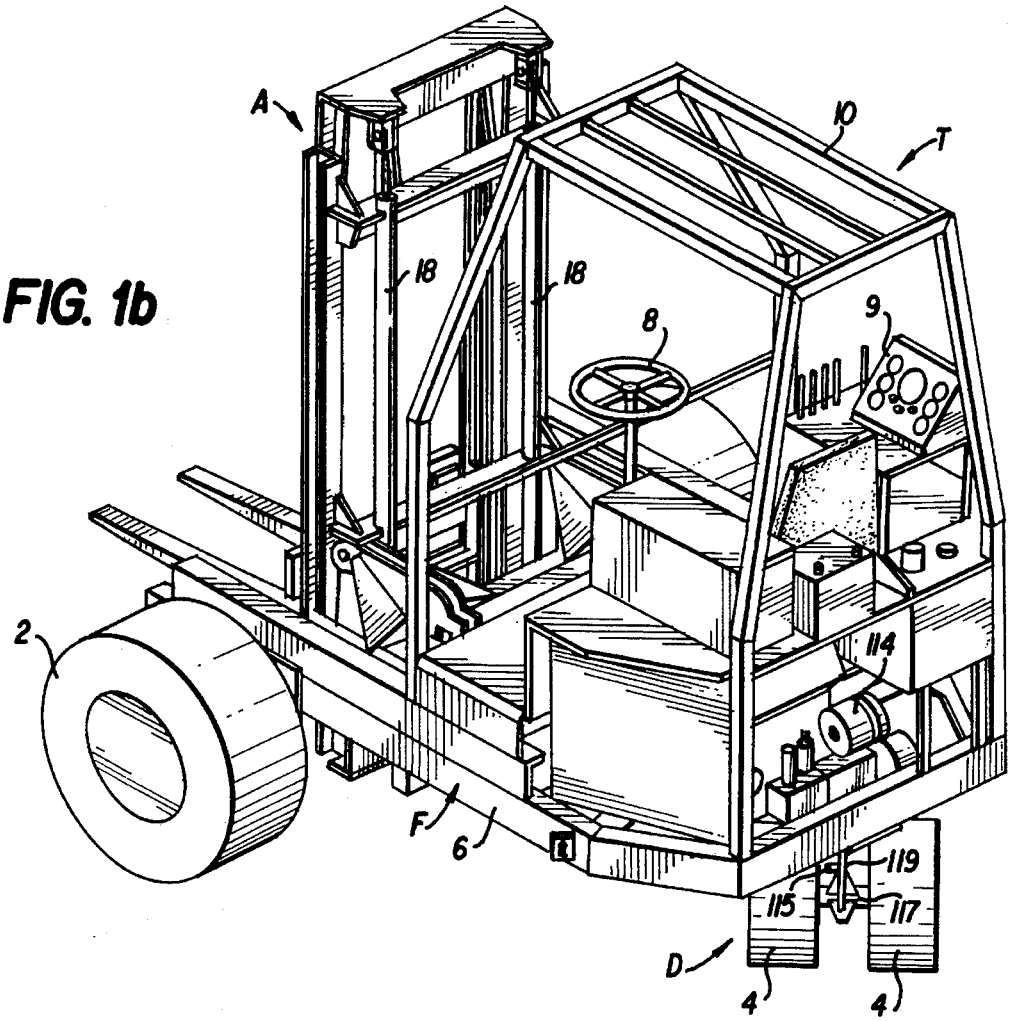
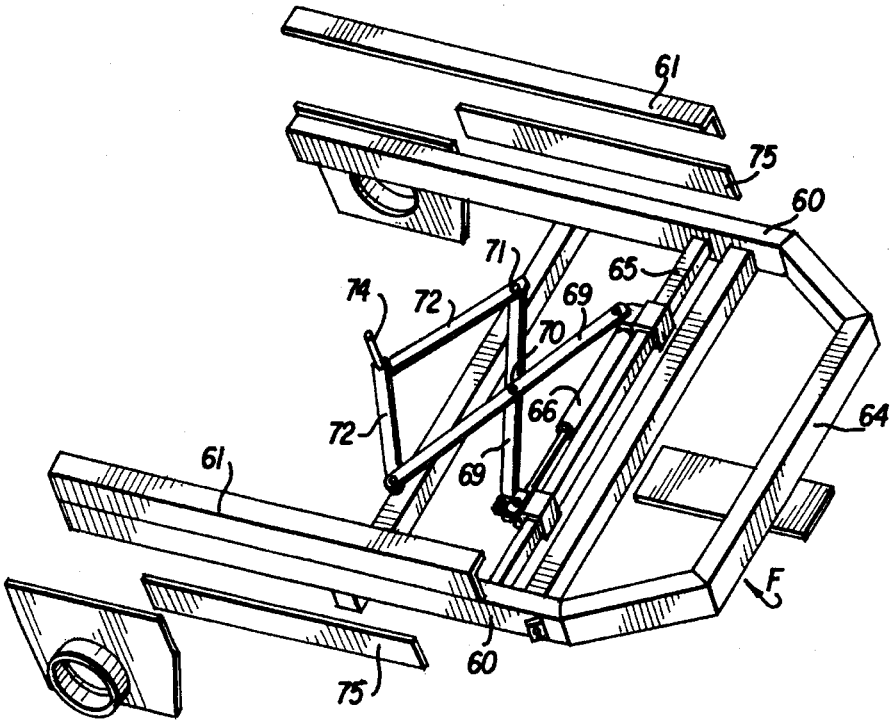
FIG. 10

FIG. 2a
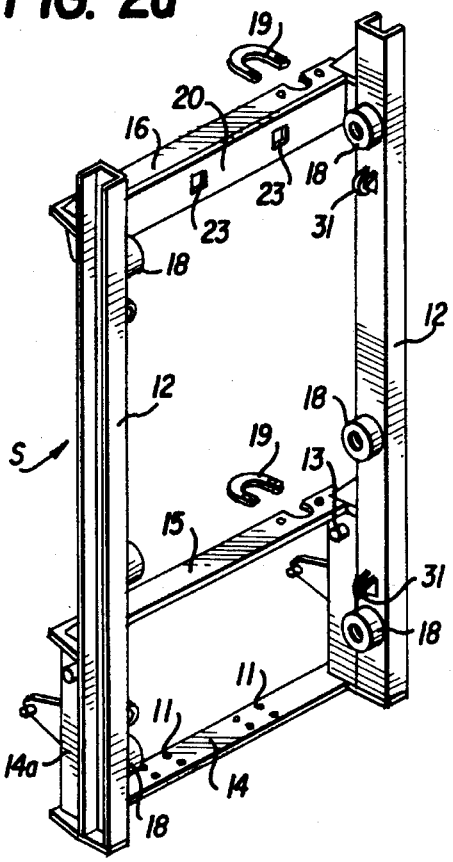
FIG. 2b
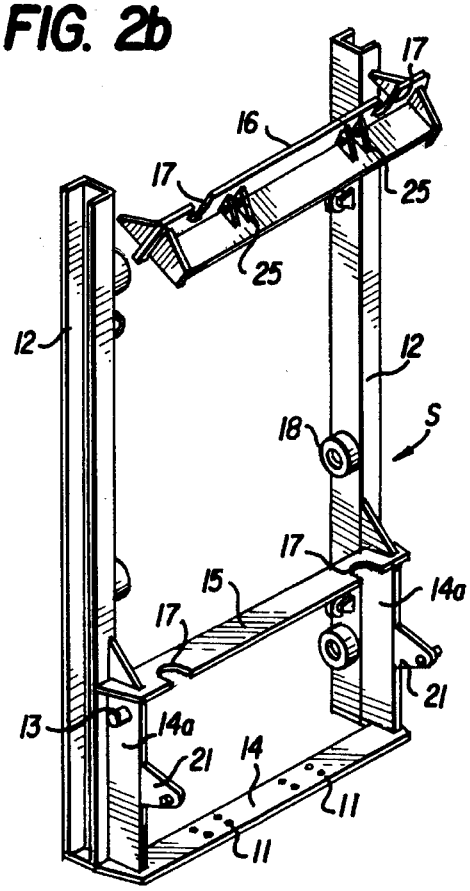
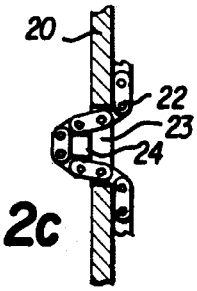
FIG. 2c
FIG. 11d
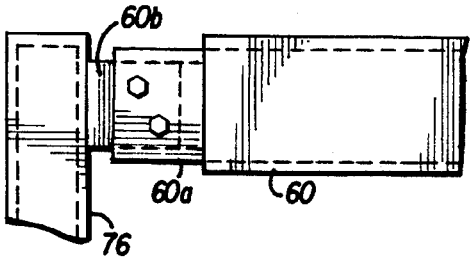
FIG. 11a
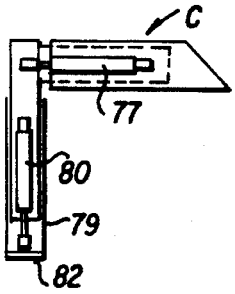
FIG. 11b
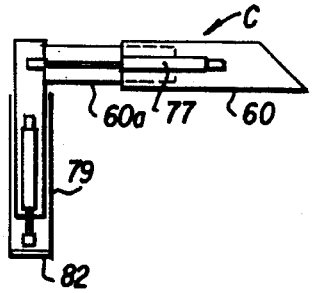
FIG. 11c
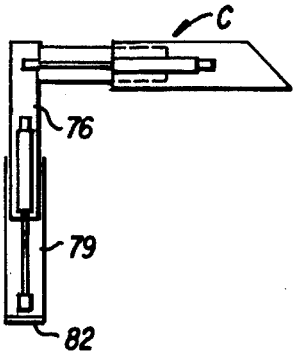

FIG. 5a
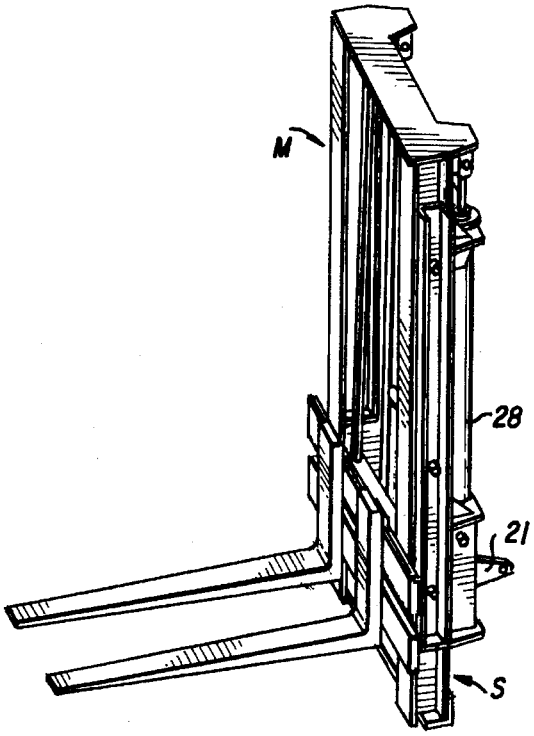
FIG. 5b
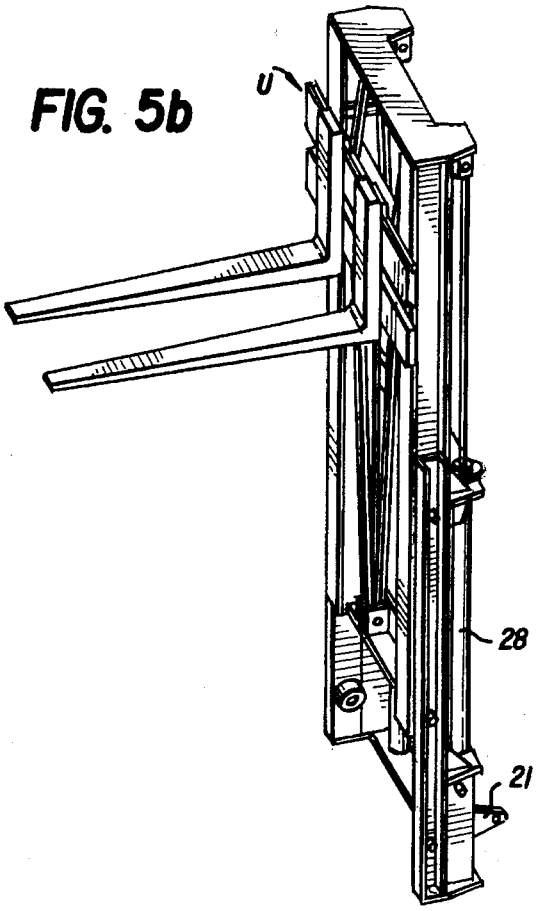
FIG. 7a
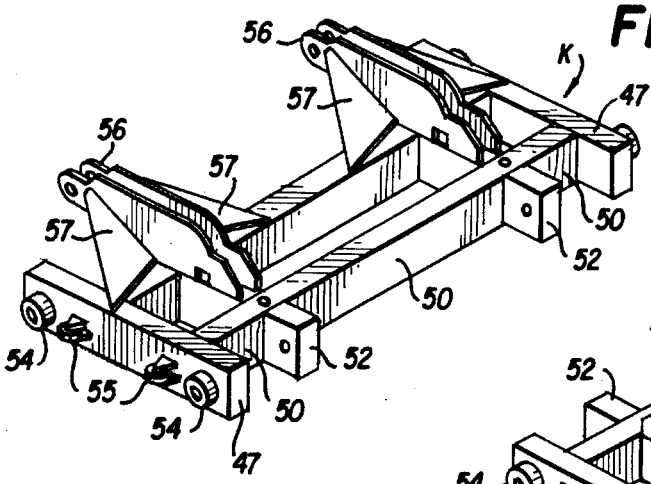
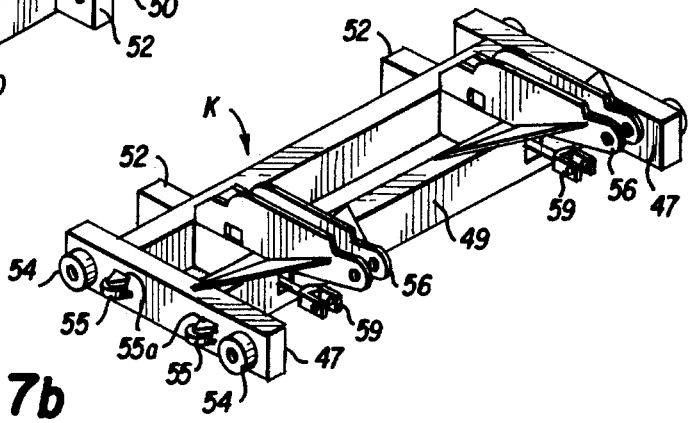
FIG. 7b

FORK LIFT TRUCK

FIELD OF THE INVENTION

The present invention relates generally to the field of fork lift trucks. More particularly it relates to transportable fork lift truck which are relatively light in weight while being capable of handling heavy loads.

BACKGROUND

There are many types of fork lift trucks designed for material handling applications.

A number of such fork lift trucks use a chain-link drive mechanism combined with sprocket wheels to raise and/or lower the forks on a mast. Prior to the use of chain-link drives, rigid piston-cylinder combinations were more common. Chain-link drives provide greater flexibility and greater distances of vertical travel than piston-cylinder arrangements. Chain operated fork lift trucks are disclosed in U.S. Pat. Nos. 4,621,711; 4,531,615; 4,369,861, 4,921,075; and 4,312,427.

In the instant invention the arrangement of the mast provides downward force or pressure and further provides a substantial clearance between the bottom of the mast and the ground level.

The invention is adapted to be securely mounted and transported on the back of a trailer or truck. In this manner, the fork lift truck can be conveniently transported directly to the work site,along with the load to be moved. For a fork lift truck to be effectively used in this manner, it should be lightweight, and yet at the same time should be capable of lifting heavy loads. To provide heavy lifting capability while minimizing the weight of the fork lift truck, it is advantageous for the forks to have the capacity to be shifted from a position forward of the front wheels to a position behind them thereby relocating the center of gravity of the load towards the center of gravity of the vehicle and thus increasing the lifting capacity of the lift truck.

A horizontally movable mast carriage system which has a pair of parallel hydraulic cylinders is disclosed in U.S. Pat. No. 4,921,075. There are inherent limitations in a parallel cylinder design, however, which the present invention overcomes by increasing the range of the lift's horizontal travel while employing a compact carriage system.

The prior art also discloses fork lift trucks which utilize heavy counterweights on their ends thereby increasing the load handling capability of the vehicle. Such mechanisms are, of course, inconsistent with the need to minimize the weight of a truck designed to be transported with the load to be moved.

Prior art trucks may avoid the need to use a heavy counterweights by positioning the forks and the load they carry between the front and the rear wheels. However, this type of design has been generally limited to applications where the load to be lifted is at ground level.

Examples of such vehicles are disclosed in U.S. Pat. Nos. 3,321,109; 3,861,535, 3,610,453; and 3,039,647.

The instant invention provides novel variable positioning outriggers for stabilization of the device. But, of course, the utilization of outriggers, as such for this purpose, are not unknown. Outriggers have been used as alternatives to counterweights. Various outriggers are disclosed in U.S. Pat. Nos. 3,586,183; 3,235,105 and 4,921,075.

SUMMARY OF THE INVENTION

The present invention provides a new and improved fork lift truck design that is lightweight, compact and easily transportable, while having the capacity to move relatively heavy loads.

The invention includes a scissor-configured horizontal carriage system wherein the forks can be readily moved from a position forward of the front wheels to one behind them. An object of this invention is to provide a mechanism whereby the overall horizontal travel of the lift fork is maximized while, at the same time, the overall length of the fork lift truck is kept to a minimum. Because the fork lift truck in accordance with the invention is intended to be transportable on the aft end of a trailer and in view of applicable transportation regulations as well as concerns for safety and the dynamic effects of a trailing load, the overall length of the fork lift truck is kept to a minimum.

The invention further provides a new and advantageous mast arrangement. The unique design provides negative lift positioning below the ground level, positive lift positioning above the level of the fork lift truck, and a downward force or pressure applied to the forks when the mast is in its negative lift position.

This downward force or pressure feature is useful for raising the front wheels of the fork life truck for servicing and is also useful to apply a force by the mast relative to the remainder of the fork lift truck to securely mount it on the back of a trailer for transportation purposes.

The mast design disclosed herein has the additional advantage of providing relatively large ground clearances under the mast and under the forks. This enables the fork lift truck to travel over rough and irregular terrain, as well as to negotiate street curbs or other obstacles encountered while operating in an urban environment.

The invention yet further incorporates an innovative outrigger design. The outriggers extend horizontally from the front end of the fork-like frame, and once positioned horizontally, extend vertically to establish a firm contact with the underlying ground surface. The outriggers stabilize the fork lift truck when the mast is extended with the horizontal carriage system positioned forward of the front wheels.

The outriggers are in hydraulic communication with each other and are separated with a pressure sensitive bypass valve. In the event one of the outriggers contacts an obstruction when it is being extended forward, the internal hydraulic pressure increases thereby closing the pressure sensitive bypass valve. As the bypass valve closes, the hydraulic fluid flowing to the obstructed outrigger is shut off, causing it to remain stationary, while the other unobstructed outrigger continues to extend horizontally.

The fork lift truck, having this unique outrigger system provides an unusual stability in areas where obstructions are frequently encountered, such as, for example, rear wheels associated with a flat bed trailer that effectively block and prevent the use of the outriggers provided on outrigger systems and conventional fork lift trucks.

The fork lift truck is typically powered by a diesel or gasoline engine. The engine is mounted in the rear of the fork lift truck under the driver's seat. It is directly coupled to a variable displacement double transmission hydraulic pump with an auxiliary pump which provides hydraulic power to the wheel hub motors and the hydraulic cylinders. The fuel tank and the hydraulic oil reservoir are positioned over the hydraulic pump in the rear of the fork lift truck.

The fork lift truck is typically provided with a hydraulic steering system. The steering wheel tilts forward, backwards, and rotates. The hydraulic wheel hub motors are provided with power from the double hydraulic pump. The double hydraulic pump is reversing and is interfaced to the hydraulic wheel hub motors with hydraulic conduits. The wheel hub motors may turn in the forward or reverse direction, depending upon the direction that the steering wheel is turned. For example, when the steering wheel rotates left, the right drive wheel rotates forward, while the left drive wheel rotates backwards, thereby causing the fork lift truck to turn to the left. Similarly, when the steering wheel is rotated to the right, the fork lift truck turns to the right. By allowing one wheel hub motor to rotate backwards, while the other wheel hub motor rotates forwards, the fork lift truck is capable of turning in a very responsive manner.

When the steering wheel is pushed in a forward direction, both of the drive wheels begin to turn forward, and the fork lift truck moves forward. Similarly, when the steering wheel is pulled backwards, the fork lift truck moves backwards. The further the steering wheel is pushed forward or moved backwards, the faster the drive wheels will turn. An accelerator pedal is provided to increase the engine speed. When the steering wheel is released, springs which are provided on the hydraulic pump turn the steering wheel to the center, and all motion stops.

BRIEF DESCRIPTION OF THE DRAWINGS

A better understanding of the invention may be appreciated from the detailed description of a preferred embodiment of the invention set forth below, considered in conjunction with the accompanying drawings, in which:

FIG. 1*b* is a further isometric view of the fork lift of FIG. 1*a;*

FIGS. 2*a* and 2*b* are isometric views of opposite sides of the stationary frame portion of the mast;

FIG. 2*c* is a detailed sectional view illustrating how the roller lift chains are secured to the upper cross brace of the stationary frame portion shown in FIGS. 2*a* and 2*b;*

FIGS. 5*a* and 5*b* are isometric views of the assembled mast in a lowered and in a raised position, respectively;

FIGS. 7*a* and 7*b* are isometric views of opposite sides of the horizontal carriage;

FIG. 10 is an expanded view of the frame which illustrates the scissor-shaped horizontal motion system in the retracted position;

FIGS. 11*a*, 11*b* and 11*c* are side elevational views that illustrate different positions of an individual outrigger; and FIG. 11*d* is a detailed side elevational view illustrating how the horizontal and vertical telescoping parts of each outrigger are connected.

DETAILED DESCRIPTION OF THE PREFERRED EMBODIMENT

Figure 1A:
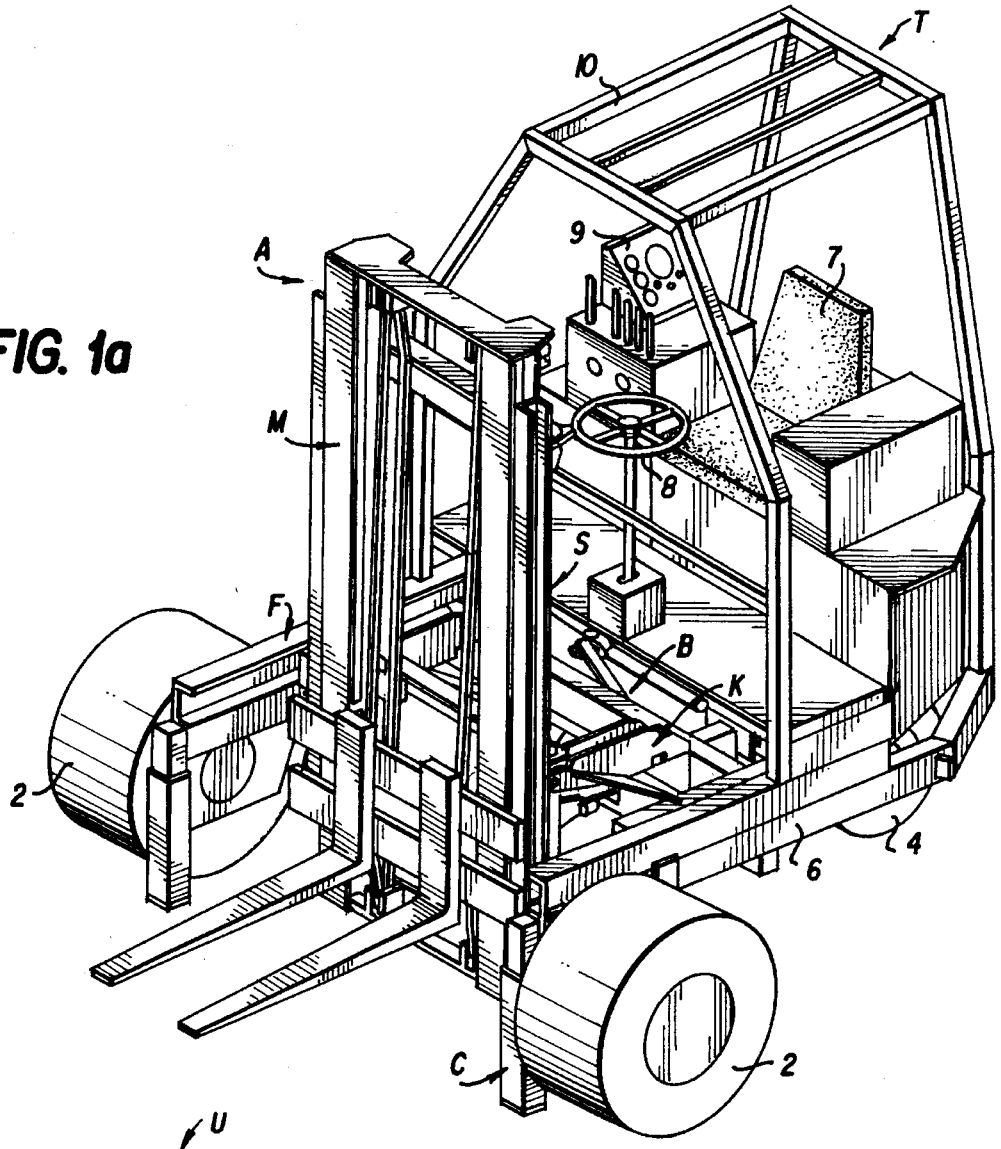
FIG. 1*a* an isometric view of a fork lift truck in accordance with the invention, wherein the mast assembly is in its partially extended forward position; both outriggers are in the retracted position, and the partially exposed scissor-configured horizontal movement mechanism for the mast carriage.

FIGS. 1*a* and 1*b* illustrate an assembled fork lift truck, designated generally as T, which is the subject of the instant invention. The fork lift truck is designed to be light in weight, compact, and, at the same time, capable of lifting heavy loads.

Referring to FIGS. 1*a* and 1*b*, the preferred embodiment of the instant invention is shown. Fork lift truck T is typically propelled with hydraulically actuated drive wheels 2, and includes a free wheeling rear wheel 4. Hydraulic power is provided to the drive wheels 2 with the double acting hydraulic pump 114.

The drive wheels 2 are rotated with wheel hub motors 2*m* which are attached to the double acting hydraulic pump 114 with hydraulic conduits. The double acting hydraulic pump 114 can cause the drive wheels to move in either the forward or reverse direction. For example, when the steering wheel 8 is rotated to the left (counterclockwise), the right drive wheel 2 rotates forward, and the left drive wheel rotates backwards, thereby causing the fork lift truck to turn to the left. Similarly, when the steering wheel 8 is rotated to the right (clockwise), the fork lift truck turns to the right.

When the steering wheel 8 is pushed forward, both of the drive wheels 2 turn forward, causing the fork lift truck T to travel forward. Similarly, when the steering wheel 8 is pulled to the rear, the fork lift truck travels backwards.

The free wheeling wheels 4 are mounted on an axle 117. The shaft 119 may be fixed in position to prevent rotation by inserting pin 115. This secured position is typically used when the fork lift truck T is transported.

The front and rear wheels 2 and 4 are mounted on a frame F that includes two parallel horizontally extending leg members 6. Also included in truck T are a driver's seat 7, a control panel 9 for the various components of the fork lift truck T hereinafter described, and a protective cage 10.

Figure 4A:
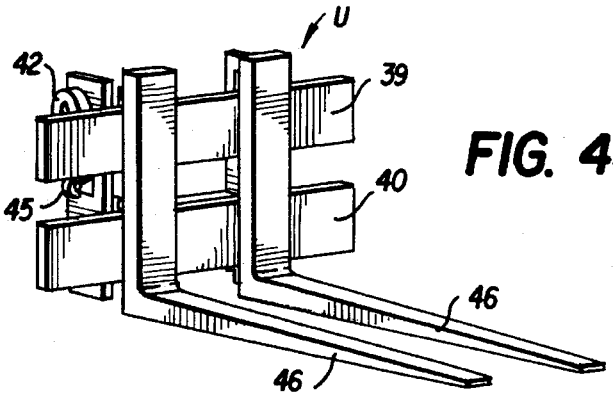
FIGS. 4*a* and 4*b* are isometric views of opposite sides of the u vertical carriage portion of the mast which include the lifting forks.
Figure 4B:
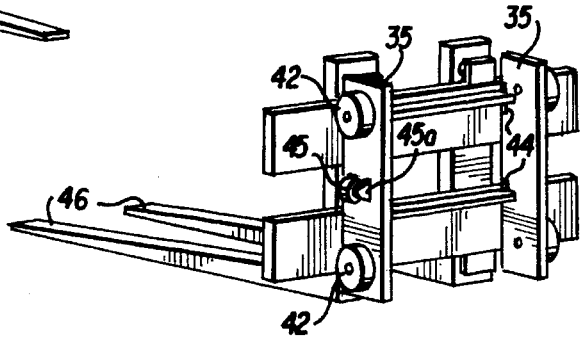

The mast assembly A is shown in more detail in FIGS. 2*a*, 2*b*, 2*c*, 3*a*, 3*b*, 4*a*, 4*b*, 5*a*, 5*b*, 6*a* and 6*b*. The mast assembly includes: (1) a stationary frame S (FIGS. 2*a*, 2*b* and 2*c*), (2) a moveable frame M (FIGS. 3*a* and 3*b*), and a vertical carriage U (FIGS. 4*a* and 4*b*).

Stationary frame S is generally constructed of two main channel beams 12 secured together in a parallel relationship with three permanently attached groups of horizontal cross supports comprising a lower horizontal cross brace 14, a middle horizontal cross brace 15, and an upper horizontal cross brace 16. The stationary frame S typically includes three main rollers 18 on the inside face of each of the two channel beams 12.

The lower horizontal cross brace 14 is positioned across the bottom of main channels 12 and includes threaded holes 11 to which the hydraulic mast cylinders 28 are attached.

A carriage pin 13 is inserted through each of the vertical plates 14*a* so as to extend outwardly from each side thereof. The carriage pins 13 attach mast M to the horizontal carriage K, as will be discussed hereinafter.

An ear 21 is attached to each of the lower vertical plates 14*a* extending upwardly from cross braces 14 and affixed to beams 12. Ears 21 are used to connect to the hydraulic cylinders 59 (FIG. 7*b*) that are attached to the horizontal carriage K.

Middle horizontal cross brace 15 is positioned above the lower horizontal cross brace 14 and connects vertical braces 14*a*. The upper horizontal cross brace 16 joins main channel beams 12 proximate, but slightly below, their upper ends.

The middle and upper horizontal cross braces 15 and 16 each include two slots 17 which are aligned vertically and in which the two hydraulic mast cylinders 28 are received (See FIGS. 5*a* and 5*b*).

Hydraulic mast cylinders 28 are firmly secured within each of slots 17 in the middle and upper horizontal cross braces 15 by clamps 19.

An upper vertically disposed horizontally extending cross brace 20 is permanently attached to upper horizontal cross brace 16. Brace 20 includes two square openings 23.

FIG. 2*c* illustrates in detail how each of two roller lift chains 22 is received through one of two square openings 23. Each is removably secured therein to the upper vertical cross brace 20 by means of separate pin 24 having a square or rectangular cross-section. Pins 24 are inserted behind the respective roller lift chains 22, and through gussets 25 which are firmly attached at the inner corner defined by the junction of upper horizontal cross brace 16 and upper vertical cross brace 20.

Figure 3A:
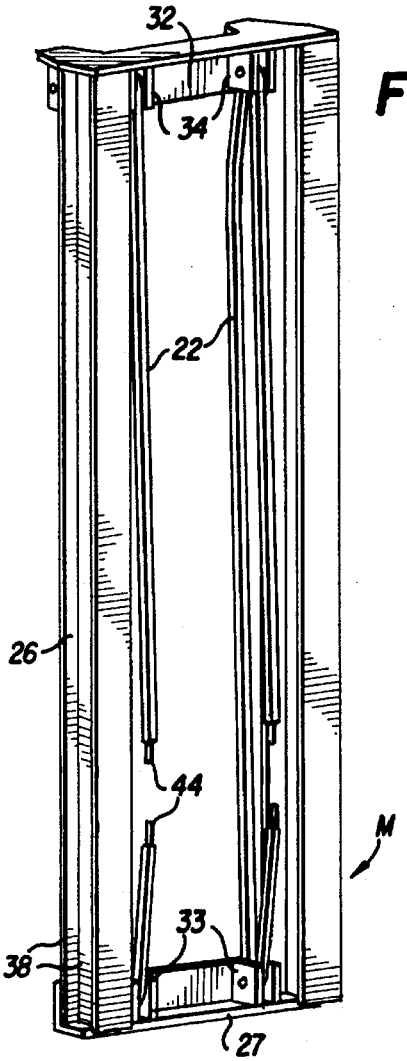
FIGS. 3*a* and 3*b* are isometric views of opposite sides of the moveable frame portion of the mast.
Figure 3B:
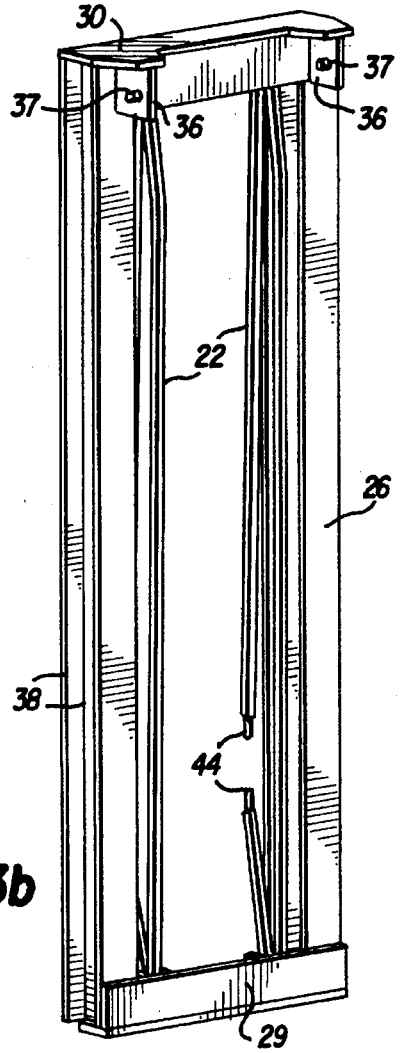

The moveable frame M of FIGS. 3*a* and 3*b* is generally constructed of two wide flange beams 26 that are secured in a parallel relationship by two rigidly attached groups of cross braces 27 and 30.

The lower cross brace 27 is rigidly connected to the bottoms of the wide flange beams 26. A lower vertically disposed cross brace 29 is rigidly attached to both lower cross brace 27 and wide flange beams 26.

An upper cross brace 30 is permanently attached to the top of the wide flange beams 26. An upper vertical cross brace 32 is permanently attached to the upper cross brace 30 and the two wide flange beams 26 in their lower aspects.

Two pairs of roller brackets 33 and 34 are attached at the inside intersection between the lower cross brace 27 and the lower vertical cross brace 29, as well as at the intersection between the upper cross brace 30 and the upper vertical cross brace 32.

Lift chain sprockets (not shown) are rotatably received in brackets 33 and 34 and serve as carriers for the roller lift chains 22 (shown diagrammatically), that rotate on the sprockets within each of the roller brackets 33 and 34.

Two cylinder mount tabs 36 extend rigidly from both upper cross brace 30 and upper vertical cross brace 32. The upper end of each of the hydraulic mast cylinders attaches to a pin 37 which is received through the corresponding cylinder mount tab 36.

Wear plates 38 removably line the inner and outer faces of the flanges of wide flange beams 26, and provide a replaceable bearing surface for the main rollers 42 disposed on the fork's vertical carriage U as seen in FIG. 4*b* and the guide rollers 45 of the vertical carriage U (FIGS. 4*a* and 4*b*), as well as for the main rollers 18 and guide rollers 31 of the stationary frame S (FIGS. 2*a* and 2*b*). The relationship between the moveable frame M, the vertical carriage U, and the stationary frame S, will be described subsequently.

The vertical carriage U is generally constructed of two vertical members 35 to which an upper tine support 39 and a lower tine support 40 are rigidly attached.

Two main rollers 42 are rotatably mounted on the outer faces of the vertical members 35, being journalled on shafts that extend outwardly from each face thereof.

A further guide roller 45 is rotatably mounted on the outer face of each of the vertical members 35 by means of parallel brackets 45*a*. The outer engaging surface of each guide roller 42 is disposed perpendicular to the outer faces of vertical members 35, and each guide roller 45 is positioned between the two main rollers 42 with the axis of rotation of each roller 45 being parallel to the outer faces of vertical members 35.

Lifting forks or tines 46 are adjustably secured to extend horizontally outwardly from the upper tine support 39 and the lower tine support 40.

The main rollers 42 of the vertical carriage U travel vertically along the length of the inside face of the wide flange beams 26 of the moveable frame M (FIGS. 3*a* and 3*b*), while the guide rollers 45 center the vertical carriage U between the wide flange beams 26 of the moveable frame M.

The main rollers 18 of the stationary frame S are disposed within the outer face of wide flange beams 26 of the movable frame M (FIGS. 2*a*, 2*b*, 3*a*, 3*b*, 4*a* and 4*b*). Guide rollers 31 of the stationary frame S center and provide a roller bearing surface for the moveable frame M between main channels 12 of stationary frame S.

Each roller lift chain 22 is rotatably engaged by the rotatable sprockets between sprocket brackets 33 and 34, located at opposite ends of the moveable frame M (FIGS. 3*a* and 3*b*).

Each end of the roller lift chain 22 has a threaded bolt 44 that connects to the upper and lower aspects of vertical carriage U. Each roller lift chain 22 is secured, it will be recalled, in a removably locked position by square pins 24, as shown in FIGS. 2*a*, 2*b* and 2*c*, to stationary frame S.

The hydraulic mast cylinders 28, as shown in FIGS. 5*a* and 5*b*, are attached at their respective lower ends to the threaded holes 11 through lower horizontal cross brace 14 of stationary frame S. The upper ends of hydraulic mast cylinders 28 are attached to the pins 37 mounted to extend normally from cylinder mount tabs 36, as previously described.

As the hydraulic mast cylinder 28 is raised, the moveable frame M is also raised. The vertical motion of the moveable frame M causes the roller lift chain 22 to move the vertical carriage U a distance equal to twice the vertical distance travelled by the hydraulic mast cylinder 18.

The hydraulic mast cylinder 28 is a double-acting piston and cylinder combination whereby when hydraulic pressure is applied below the internal piston of the hydraulic mast cylinder 28, moveable frame M, the vertical carriage U, and the lifting tines 46, are forced upwards to lift a load carried by tines 46. When hydraulic pressure is applied above the internal piston of the hydraulic mast cylinder 28, moveable frame M, the vertical carriage U and the lifting tines 46, are forced downwardly a sufficient distance to raise the front end of the fork lift truck T from the ground or for the purpose of securely fastening the fork lift truck to the rear end of a trailer so it can be carried in a "piggy back" position.

The horizontal carriage K is depicted in FIGS. 7*a*, 7*b*, 8*a* and 8*b*, the general construction of horizontal carriage K being illustrated in FIGS. 7*a* and 7*b*. It comprises main longitudinal tubes 47 which are permanently connected in a parallel relationship by a front cross tube 49, that spans the entire width between the two main longitudinal tubes 47, and a set of three rear cross tubes 50 that extend across the spaces defined between the insides of tubes 47 and the interior longitudinal tubes 52.

Rotatably mounted on each of the two outside vertical faces of main longitudinal tubes 47 are two main rollers 54. Main rollers 54 are rotatably mounted on main longitudinal tubes 47 via roller shafts which are received through main longitudinal tubes 47.

Two guide rollers 55 are rotatably mounted between brackets and extending normally from each of the outside vertical faces of main longitudinal tubes 47.

Two pairs of mast mount brackets 56 are securely attached to the tops of interior longitudinal tubes 52. These mast mounted brackets 56 are stiffened and reinforced by wing plates 57 disposed to extend from each side of mast mount brackets 56 and rigidly connected inboard to tube 49 and outboard to tubes 47.

The stationary frame S portion of the mast is attached to the horizontal carriage K by means of carriage pins 13 (FIGS. 2*a* and 2*b*) that are received through aligned openings provided in mast mount brackets 56. A tilt hydraulic cylinder and piston combination 59 is attached with pins to the interiors of each of longitudinal tubes 52.

The entire mast assembly may be tilted forwardly and rearwardly by applying hydraulic pressure to the tilt hydraulic cylinder and piston comb[nation 59 as will be appreciated from FIGS. 6*a*, 6*b*, 8*a* and 8*b*.

Figure 9A:
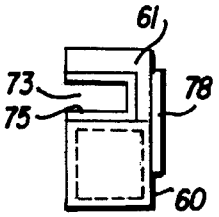
FIG. 9*a* is an end view of the main horizontal frame and connected angle iron pieces with a wear plate carried between them.
Figure 9B:
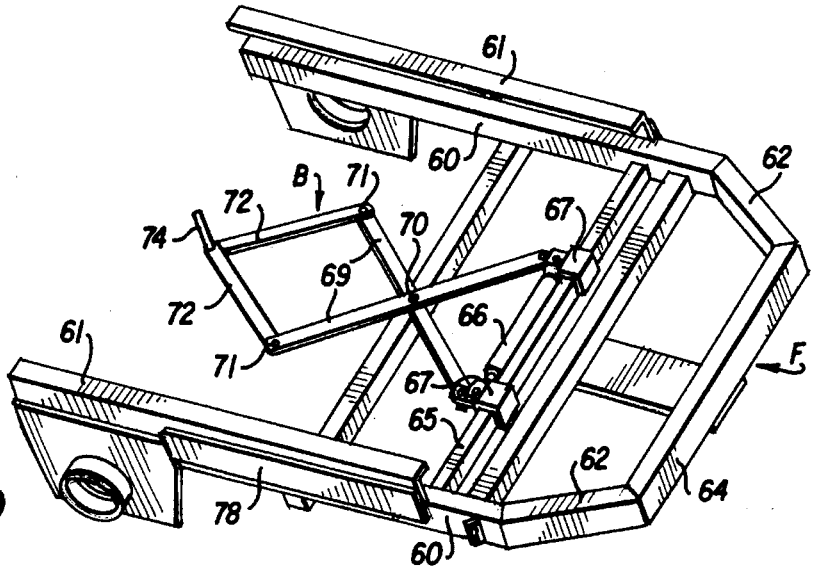
FIG. 9*b* is an isometric view of the main frame which illustrates the scissor-shaped horizontal motion arrangement in extended position.
Figure 6A:
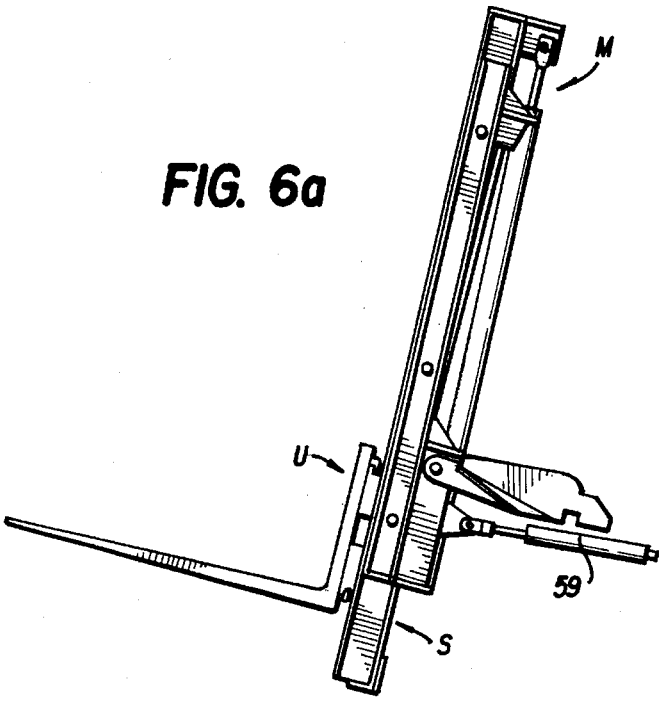
FIGS. 6*a* and 6*b* are side elevational views that illustrate the mast arranged for tilting rearwardly and forwardly, respectively.
Figure 6B:
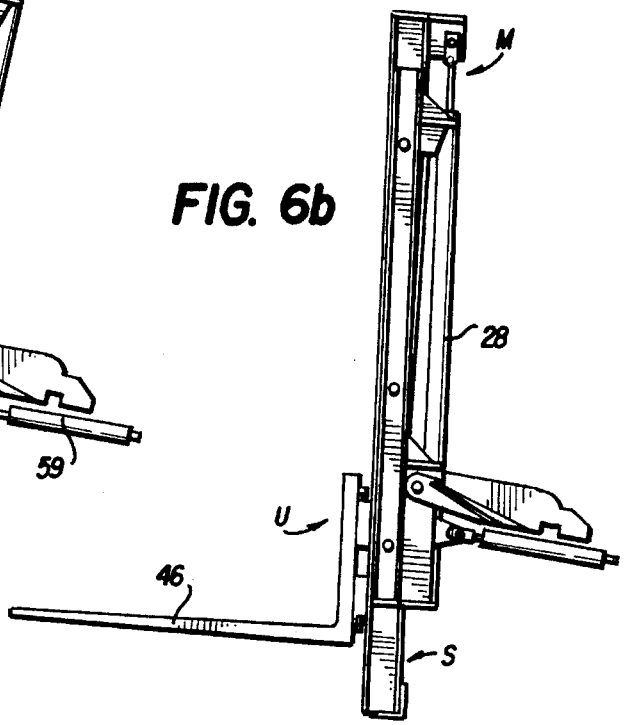
Figure 8A:
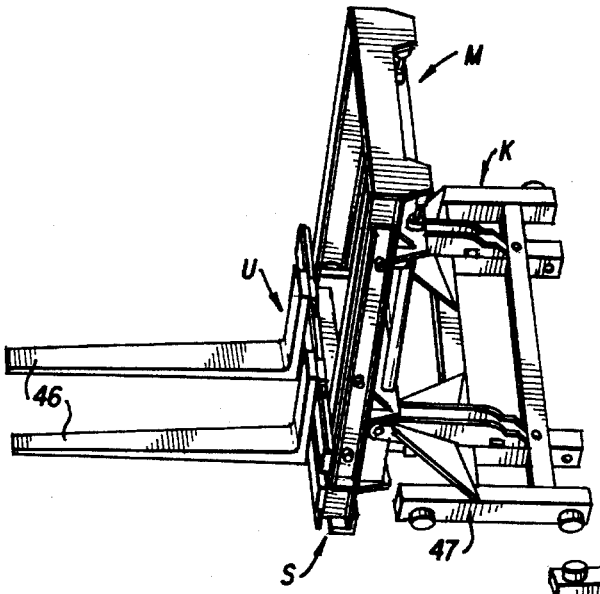
FIGS. 8*a* and 8*b* are isometric views illustrating the upper and lower arrangements, respectively, of the mast assembly with the horizontal carriage attached thereto.
Figure 8B:
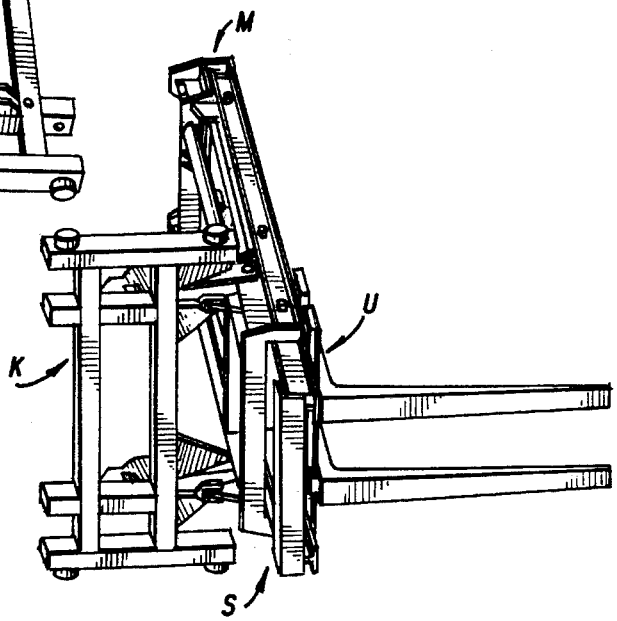

Main frame F of the truck T as illustrated overall in FIG. 9*b* of the instant invention is generally constructed of rectangular tubing and includes two main horizontal parallel frames 60 permanently attached to two diagonal main frame member 62 that are rigidly joined by rear frame cross support 64. Attached along the length of each of the main horizontal frames 60 are angle iron pieces 61 having L-shaped cross-sections. Reinforcement plates 78 provide a reinforcing interface between the main horizontal frame 60 and the angle iron pieces 61.

A scissor-extension horizontal motion system B is provided in the main frame as illustrated in FIGS. 9*b* and 10.

Scissor-actuated horizontal motion system B is mounted on main frame F and is described as follows: A tubular bar 65 is removably attached at each end to the inside walls of main horizontal frames 60. A hydraulic piston and cylinder set 66 has attached thereto at each end babbitt metal lined tubes 67. The babbitt metal lined tubes 67 are slidably received by tubular bar 65 so that as the hydraulic piston and cylinder set 66 is extended and retracted, the babbitt metal lined tubes 67 slide along the outer surfaces of tubular bar 65.

Each end of the hydraulic piston and cylinder set 66 is attached to a bar 69 of a scissor type extension mechanism B. The scissor bars 69 are typically flat and cross at their centers, at which point they are slidably connected with a pin 70 to be rotatable through a portion of an arc about pin 70. Each of the ends of the scissor bars 69 opposite their connection to set 66 are connected by pins 71 to the connecting bars 72. Connecting bars 72 are joined at their ends opposite scissor bars 69 with a shaft 74 which extends upwardly from its connection to both connecting bars 72.

Main rollers 54 of horizontal carriage K are received to move in a track formed by the main horizontal frame 60 and the L-shaped angle iron 61 as seen in FIGS. 9*a* and 10. The track 73 thus formed is lined with wear plates 75 to provide a wear surface for longer life and ease of replacement.

Rear cross tube 50 of horizontal carriage K is attached to shaft 74 of the scissor-actuated horizontal motion system so that piston and hydraulic set 66 is spaced therefrom and as it is retracted, the horizontal carriage K and mast assembly A are caused to be moved forwardly, and when the hydraulic cylinder 66 is extended, the horizontal carriage K and mast assembly A are caused to move rearwardly. The main rollers 54 travel along the length of track 73 (See FIGS. 1*a*, 7*a*, 7*b*, 9*b* and 10).

An individual outrigger C is illustrated in detail in FIGS. 11*a*, 11*b*, 11*c* and 11*d*. The outriggers C stabilize the fork lift truck T when the horizontal carriage K extends mast A forward to lift a heavy load. Outriggers C are retracted when the load is positioned behind the main drive wheels 2 and the fork lift truck is ready to move. There are two outriggers C, one being attached to each of the main horizontal frames 60 of the main frame.

Outriggers C are generally constructed of tubular steel. A horizontal tube 60*a* is slidably received in a telescoping fashion in each main horizontal frame 60. A short tube 60*b* is inserted into the outer end of the horizontal tube 60*a*. The short tube member 60*b* is coupled at a right angle to a fixed vertical tube 76. A horizontal hydraulic piston and cylinder set 77 is connected at one end by means of a pin to an exterior vertical wall of main horizontal frame 60 and at the other end by means of a further pin to the fixed vertical tube 76. By appropriate actuation of the horizontal hydraulic piston at cylinder set 77, tube 60*a* may extend from or retract into tube 60 to provide selected positioning of each outrigger C in a horizontal direction.

The fixed vertical tube 76 is slidably and telescopically received in a moveable vertical tube 79 which has a ground engaging pad 82 mounted on its lowermost end. A vertical hydraulic piston and cylinder set 80 is connected at one end by a pin to the outer wall of the fixed vertical tube 76 and at its other end by a pin to the moveable vertical tube 79. The vertical hydraulic piston at cylinder set 80 may be actuated by the truck T's hydraulic system to provide selected positioning of the outriggers in a vertical direction to raise or lower the tubes 79.

Horizontal hydraulic piston and cylinder sets 77 are connected to a hydraulic pressure source that includes for each set a valve which closes upon reaching a pre-determined pressure. The result is that if an outrigger is being extended horizontally and encounters an obstruction, the hydraulic pressure on the obstructed side of the hydraulic loop immediately is increased. When the pressure on the obstructed side of the hydraulic loop reaches a pre-determined amount, the valve closes, restricting further horizontal motion by the obstructed outrigger while maintaining it in the position it reached when the valve closed, and providing, at the same time, continued hydraulic pressure to the unobstructed side of the hydraulic loop to extend the unobstructed outrigger. Vicker's transmission hydraulic pumps 114 comprise two transmission pumps and one gear pump assembled as a unit. White wheel motors 2*m* are used. Hydraulic pumps 114 are powered by a Volkswagon 1.6 liter diesel engine.

The foregoing disclosure and description of the invention are illustrative and explanatory thereof, and various changes in the size, shape and materials, as well as the details of the illustrated construction may be made without departing from the spirit of the invention.

Having disclosed our invention, what we claim as new and to be secured by Letters Patent of the United States is:

1. An improved fork lift truck comprising:

a horizontal frame having legs, the legs of the horizontal frame being substantially parallel, the legs having a transversely connected end and an open end;

a caster wheel for supporting the fork lift truck mounted on the frame at the connected end of the legs;

a seat for an operator secured to the frame adjacent the caster wheel mounting;

a scissor-actuated horizontal motion carriage mounted for effecting horizontal travel on the legs, said scissor-actuated horizontal carriage having bars with front ends, a center and rear ends, said rear ends operatively connected to a hydraulic cylinder, said center slidably connected together;

a pair of connecting bars having front ends and rear ends, each of said rear ends of said connecting bars being slidably connected to each of said front ends of said scissor-actuated horizontal carriage, said front ends of said connecting bars being slidably connected together;

a lift assembly mounted on the frame and attached to said front ends of said connecting bars, said lift assembly being vertically moveable between a position below ground level, and a position above the level of said lift truck, whereby said lift assembly may be slidably positioned forward or rearward of said front wheels; and a plurality of outrigger support members.

2. A fork lift truck in accordance with claim 1, wherein said mast assembly comprises:

a stationary frame having at least two essentially parallel main channel members, said main channel members having an inner face and an outer face;

transverse cross braces attached to said main channel members comprising:

an upper cross brace, a middle cross brace, and a lower cross brace;

at least three main rollers rotatably attached to the inner face of each of said main channel members;

a lift chain connecting means attached to said upper vertical cross brace;

a moveable frame having at least two essentially parallel wide flange beam members, said wide flange beam members each having an inner channel and an outer channel;

transverse cross braces attached to said wide flange beam members comprising:

an upper cross brace coupled with an upper vertical cross brace, and a lower cross brace coupled with a lower vertical cross brace;

at least two lift chain sprockets rotatably connected to said upper cross brace, and at least two lift chain sprockets rotatably connected to said lower cross braces, said moveable frame being slidably coupled with said stationary frame, wherein the main rollers on said stationary frame rotatably engage the outer flange of said moveable frame;

a vertical carriage having at least two essentially parallel vertical members, said vertical members having an inner face and an outer face;

an upper tine support member and a lower tine support member, said upper tine support member and said lower tine support member being essentially parallel and being coupled essentially perpendicular to said vertical members;

at least two L-shaped lifting tines being essentially parallel, and having a vertical section with an outer face and a horizontal segment, the vertical section of said lifting tines being slidably attached to said upper tine support member, and the outer face of the vertical section of said lifting tines being in compression against said lower tine support member;

at least two main rollers rotatably coupled to the outer face of each said vertical members, said vertical carriage being slidably coupled with said moveable frame, wherein the main rollers on said vertical carriage rotatably engage the inner flange of said moveable frame.

3. A fork lift truck in accordance with claim 2, wherein a lift chain means having two ends is connected at one end to said upper tine support member of said vertical carriage, said lift chain means being connected at the other end to said lower tine support member, said lift chain means traversing said lift chain sprockets on said upper cross brace of said moveable frame, and traversing said lift chain sprockets on said lower cross brace on said moveable frame, said lift chain means being removably attached to said lift chain connecting means on said stationary frame, said lift chain connecting means comprising:

at least one hydraulic mast cylinder having two ends, said hydraulic mast cylinder being attached at one end to said lower cross brace of said stationary frame, and the other end of said hydraulic mast cylinder being attached to said upper cross brace of said moveable frame, wherein as said hydraulic mast cylinder is extended, said moveable frame is raised and said lift chain means is lifted thereby raising said vertical carriage.

4. A fork lift truck in accordance with claim 2, wherein angle iron members are attached and parallel to said legs of said horizontal frame thereby forming a channel therebetween.

5. A fork lift truck in accordance with claim 4, wherein a horizontal carriage means is pivotally connected to said stationary means;

the aforementioned horizontal carriage means comprising:

at least two substantially parallel longitudinal tube members having an outer face and being transversely connected with multiple cross tube members, with at least two main rollers rotatably connected to each of the outer faces of said longitudinal tubes;

a tilting means connected between said horizontal carriage and said stationary frame, whereby said mast assembly may be tilted at predefined angular positions;

said main rollers being slidably received by said channels formed between said angle iron members and said legs of said horizontal frame.

6. A fork lift truck in accordance with claim 4, wherein said horizontal motion system comprises:

a tubular bar member having an outside surface mounted transversely to the legs of said horizontal frame;

at least two tube members slidably coupled to the outside surface of said tubular bar;

at least one hydraulic cylinder having two ends, each end being connected to one of said tube members;

at least a pair of scissor bar members having a center, a first end, and a second end, each being pivotally connected together at the center, and each being pivotally connected at the first end to one of said tube members;

at least a pair of connecting bars having two ends being pivotally connected at one end to each other and to said horizontal carriage, and each being pivotally connected at the other end to the second ends of said scissor bar members, wherein as said hydraulic cylinder is retracted, said scissor bar members and said connecting bars extend, thereby urging said mast assembly forward, and as said hydraulic cylinder is extended, said scissor bar members and said connecting bars retract, thereby urging said mast assembly rearward.

7. A fork lift truck in accordance with claim 5, wherein said tubular members include a babbitt metal lining, wherein the babbitt metal lining is in slidable contact with the outside of said tubular bar.

8. A fork lift truck in accordance with claim 4, comprising wear plate members which are substantially similar in size to the channel formed between said angle iron members, and said legs of said horizontal frame, and are removably attached therebetween.

9. In improved fork lift truck comprising:

a horizontal frame having legs, the legs of the horizontal frame being substantially parallel, the legs having a transversely connected end and an open end;

a pair of front wheels mounted on the legs, one ground engaging wheel on each side of the frame at the open end of the frame;

a caster wheel mounted on the frame at the connected end of the legs;

a seat for an operator secured to the frame adjacent the caster wheel mounting;

a scissor-actuated horizontal motion system mounted for horizontal travel on the legs;

a lift assembly mounted on the frame vertically moveable between a position below ground level and a position above the level of said fork lift truck;

a plurality after support members; said lift assembly comprising:

a stationary frame having at least two essentially parallel main channel members, said main channel members having an inner face and an outer face;

transverse cross braces attached to said main channel members comprising:

an upper cross brace, a middle cross brace, and a lower cross brace;

at least two main rollers rotatably attached to the inner face of each of said main channel members;

a lift chain connecting means attached to said upper vertical cross brace;

a moveable frame having at least two essentially parallel wide flange beam members, said wide flange beam members each having an inner channel and an outer channel;

transverse cross braces attached to said wide flange beam members comprising:

an upper cross brace coupled with an upper vertical cross brace, and a lower cross brace coupled with a lower vertical cross brace;

at least two lift chain sprockets rotatably connected to said upper cross brace, and at least two lift chain sprockets rotatably connected to said lower cross braces, said moveable frame being slidably coupled with said stationary frame, wherein the main rollers on said stationary frame rotatably engage the outer flange of said moveable frame;

a vertical carriage having at least two essentially parallel vertical members, said vertical members having an inner face and an outer face;

an upper tine support member and a lower tine support member, said upper tine support member and said lower tine support member being essentially parallel and being coupled essentially perpendicular to said vertical members;

at least two L-shaped lifting tines being essentially parallel, and having a vertical section with an outer face and a horizontal segment, the vertical section of said lifting tines being slidably attached to said upper tine support member, and the outer face of the vertical section of said lifting tines being in compression against said lower tine support member;

at least two main rollers rotatably coupled to the outer face of each said vertical members, said vertical carriage being slidably coupled with said moveable frame, wherein the main rollers on said vertical carriage rotatably engage the inner flange of said moveable frame.

10. A fork lift truck in accordance with claim 9, wherein a lift chain means having two ends is connected at one end to said upper tine support member of said vertical carriage, said lift chain means is connected at the other end to said lower tine support member, said lift chain means traverses said lift chain sprockets on said upper cross brace of said moveable frame, and traverses said lift chain sprockets on said lower cross brace on said moveable frame, said lift chain means is removably attached to said lift chain connecting means on said stationary frame;

said fork lift truck further defined by said lift chain connecting means which comprises:

at least one hydraulic mast cylinder having two ends, said hydraulic mast cylinder being attached at one end to said lower cross brace of said stationary frame, and the other end of said hydraulic mast cylinder being attached to said upper cross brace of said moveable frame, wherein as said hydraulic mast cylinder is extended, said moveable frame is raised and said lift chain means is lifted thereby raising said vertical carriage.

11. A fork lift truck in accordance with claim 9, wherein angle iron members are attached and parallel to said legs of said horizontal frame thereby forming a channel therebetween.

12. A fork lift truck in accordance with claim 11, wherein a horizontal carriage means is pivotally connected to said stationary frames;

the aforementioned horizontal carriage means comprising:

at least two substantially parallel longitudinal tube members having an outer face and being transversely connected with multiple cross tube members, with at least two main rollers rotatably connected to each of the outer faces of said longitudinal tubes;

a tilting means connected between said horizontal carriage and said stationary frame, whereby said mast assembly may be tilted at predefined angular positions;

said main rollers being slidably received by said channels formed between said angle iron members and said legs of said horizontal frame.

13. A fork lift truck in accordance with claim 11, wherein said horizontal motion system comprises:

a tubular bar member having an outside surface mounted transversely to the legs of said horizontal frame;

at least two tube members slidably coupled to the outside surface of said tubular bar;

at least one hydraulic cylinder having two ends, each end being connected to one of said tube members;

at least a pair of scissor bar members having a center, a first end, and a second end, each being pivotally connected together at the center, and each being pivotally connected at the first end to one of said tube members;

at least a pair of connecting bars having two ends being pivotally connected at one end to each other and to said horizontal carriage, and each being pivotally connected at the other end to the second ends of said scissor bar members, wherein as said hydraulic cylinder is retracted, said scissor bar members and said connecting bars extend, thereby urging said mast assembly forward, and as said hydraulic cylinder is extended, said scissor bar members and said connecting bars retract, thereby urging said mast assembly rearward.

14. A fork lift truck in accordance with claim 12, wherein said tubular members include a babbitt metal lining, wherein the babbitt metal lining is in slidable contact with the outside of said tubular bar.

15. A fork lift truck in accordance with claim 11, comprising wear plate members which are substantially similar in size to the channel formed between said angle iron members, and said legs of said horizontal frame, and are removably attached therebetween.

* * * * *